US006341655B1

(12) United States Patent
Busian et al.

(10) Patent No.: US 6,341,655 B1
(45) Date of Patent: Jan. 29, 2002

(54) EMERGENCY SHUTDOWN SYSTEM

(76) Inventors: Carl C. Busian, 108 Mullington La., Wilmington, NC (US) 28409; Earl E. Spears, 287 Jackson Plz., Ann Arbor, MI (US) 48103

( * ) Notice: Subject to any disclaimer, the term of this patent is extended or adjusted under 35 U.S.C. 154(b) by 0 days.

(21) Appl. No.: 09/527,780

(22) Filed: Mar. 17, 2000

(51) Int. Cl.[7] ..... A62C 2/00

(52) U.S. Cl. ..... 169/65; 169/68; 169/19; 169/23; 169/26; 169/59; 169/61; 169/47

(58) Field of Search ..... 169/65, 68, 19, 169/23, 16, 17, 26, 56, 61, 60, 59, 42, 46, 47

(56) References Cited

U.S. PATENT DOCUMENTS

| | | | | | |
|---|---|---|---|---|---|
| 3,653,443 | A | | 4/1972 | Dockery | |
| 4,313,501 | A | * | 2/1982 | Eckert | 169/42 |
| 4,356,870 | A | * | 11/1982 | Gaylord et al. | 169/65 |
| 4,675,541 | A | | 6/1987 | Peters et al. | |
| 4,773,485 | A | | 9/1988 | Silverman | |
| 4,813,487 | A | * | 3/1989 | Mikulec et al. | 169/65 |
| 4,830,116 | A | * | 5/1989 | Walden et al. | 169/65 |
| 4,834,188 | A | * | 5/1989 | Silverman | 169/65 |
| 4,979,572 | A | | 12/1990 | Mikulec | |
| 5,127,479 | A | | 7/1992 | Stehling et al. | |
| 5,297,636 | A | | 3/1994 | North | |
| 5,351,760 | A | | 10/1994 | Tabor, Jr. | |
| 5,628,368 | A | | 5/1997 | Sundholm | |
| 5,871,057 | A | | 2/1999 | Stehling et al. | |
| 5,990,789 | A | * | 11/1999 | Berman | 169/19 |

* cited by examiner

*Primary Examiner*—David A. Scherbel
*Assistant Examiner*—Dinh Q. Nguyen
(74) *Attorney, Agent, or Firm*—MacCord Mason PLLC

(57) ABSTRACT

Fires in kitchen appliances are detected and controlled by a detection and control system that activates a fire extinguishing system when the fire is detected, terminates the supply of electricity and/or gas to the appliances, and initiates audible and visual alarms. The audible alarm can be terminated, while the visual alarm continues until the system is restored to a pre-detection state. The system includes a control circuit, and a fire detection means with a moveable member that engages a normally closed microswitch in the control circuit to open the control circuit. Relays in the control circuit change state upon opening of the control circuit to de-energize the appliance, and audible and visual alarms are activated. The audible alarm can be manually terminated. However, the visual alarm remains activated until the system is recharged and returned to the ready state.

14 Claims, 3 Drawing Sheets

EMERGENCY SHUTDOWN SYSTEM

BACKGROUND OF THE INVENTION (1) Field of the Invention

The present invention relates generally to a system for automatically shutting down cooking appliances and/or associated equipment in accordance with NFDA recommended standards in the event of a fire, and in particular to a fail-safe system of this type that will also shut down in the event of a failure in the system, and which will continue to indicate a failure until corrections are made by authorized personnel.

(2) Description of the Prior Art

Commercial kitchens and related facilities having a plurality of cooking appliances are normally equipped with a fire extinguishing mechanism that is automatically activated in the event of a fire, such as a grease fire, at one of the appliances. The extinguishing mechanism is usually comprised of a source of an extinguishing chemical that is connected via a piping network to discharge ports that are directed toward the cooking surfaces of the appliance. A discharge valve is used to control the flow of chemicals from the source. The discharge valve is adapted to be opened when an associated mechanism detects a fire.

For example, a spring-loaded discharge valve may be held in a closed position by a taut cable, which includes one or more fusable heat links positioned above the cooking appliances. When one of the links is melted by the heat from a cooking fire, the cable is released, opening the discharge valve, and discharging fire extinguishing chemicals onto the surfaces of the cooking appliances to extinguish the fire.

An effective, complaint fire extinguishing system must also include means to disconnect the cooking appliances from the energy source when a fire is detected. Otherwise, the fire-extinguishing chemical will be exhausted, and the fire may continue or restart due to the continuing supply of energy, i.e., electricity or gas. In the case of an electrical appliance, the appliance is de-energized by opening the electrical circuit to the appliance. In the case of an gas fueled appliance, the appliance is de-energized by shutting off the gas supply, e.g., by closing a valve, such as a solenoid actuated valve.

An effective system should also include an alarm to alert others to the existence of the fire. This alarm can be activated at the time the chemical is discharged, and continues to emit a signal, e.g., a sound and/or a light signal, until manually disconnected. The inclusion of a signal mechanism is mandated by NFPA-17A of the National Fire Protection Codes for "Wet Chemical Extinguishing Systems" used for restaurant canopy hoods. NFPA-17A states:

> "A signal shall be provided to show that the system has operated, that personnel response is needed, and that the system is in need of recharge. The extinguishing system shall be connected to the fire alarm system, if provided, in accordance with the requirements of NFPA 72, National Fire Alarm Codes, so that the actuation of the extinguishing system will sound the fire alarm as well as provide the function of the extinguishing system."

Various fire extinguishing systems for use with restaurant cooking appliances have been proposed in the prior art. The following patents are representative of prior art systems:

| | |
|---|---|
| 3,653,443 | Dockery |
| 4,356,870 | Gaylord et al. |
| 4,675,541 | Peters et al. |
| 4,773,485 | Silverman |
| 4,830,116 | Walden et.al. |
| 4,979,572 | Mikulec |
| 5,127,479 | Stehling et al. |
| 5,297,636 | North |
| 5,351,760 | Tabor. Jr. |
| 5,628,368 | Sundholm |
| 5,871,057 | Stehling et al. |

Despite considerable efforts, there is still a need for a system for effectively de-energizing a plurality of cooking appliances and other restaurant equipment, as required, in the event of a fire, while emitting a signal as required by NFPA-17A. In particular, a system of this type is needed that will not only de-energize appliances in the event of a fire, but which will de-energize appliances in the event of a detected failure in the microswitch or other circuit component. Therefore, the user will not be falsely assured that a functional system is being used to monitor conditions when, in fact, the system is not functioning.

A system of this type should also be designed so that the alarm cannot be fully deactivated until the system has been recharged after a discharge of chemical, or has been repaired after a malfunction has been detected. For example, if the alarm system includes both a sound and light emitting components, the operator should be prevented from disconnected both components until the system has be recharged or repaired by authorized and skilled personnel.

SUMMARY OF THE INVENTION

The present invention is directed to a shutdown or control system for de-energizing kitchen appliances in the event of a fire. The system is used in conjunction with a fire extinguishing system comprised of a source of fire extinguishing chemical or other material, a release mechanism for releasing the fire extinguishing material in the event of a fire.

Basically, the shutdown system is comprised of a normally closed switch, positioned to be opened when the fire extinguishing system is activated, a plurality of relays that change state when the switch is opened, the relays being capable of de-energizing appliances, and an alarm mechanism that includes an audible component that can be deactivated by an operator, and a visual component that can only be deactivated by repair and recharging of the fire extinguishing system.

Preferably, the normally closed switch is positioned in the path of a component of the fire extinguishing system that moves from a ready position to a released position when a fire is detected, so that the component engages the switch to move the switch from a closed state to an open state. For example, the switch can be a microswitch that is positioned adjacent a component of a fire extinguisher discharge valve control mechanism that moves from a restrained position to a released position when a fire is detected, so that the component engages the microswitch when at the released position.

More specifically, the fire extinguishing system may be comprised of a control mechanism that includes a pivotal member moveable between first and second positions, with the pivotal member being urged toward the second position by a spring, and held in the first position by a cable that includes a heat fusable link. In the event of a fire, the heat fusable link is severed by the heat from the fire, releasing the cable and allowing the pivotal member to move under the influence of the spring to the second position.

A microswitch is positioned at the second position in the path of the pivotal member, so that a component of the pivotal member engages the microswitch to move the switch from the closed state to the open state. The pivotal member also engages a release member, such as a valve, to release fire extinguishing chemicals from a supply source, such as a pressurized tank.

The microswitch is in a primary circuit with a plurality of relays that are in secondary circuits with different appliance controllers, e.g., switches or valves. The circuits are designed so that the circuits to the appliances are in a closed or completed state when the microswitch is closed. These circuits may be designed with the relays in an open state or a closed state. Thus, for purposes of description, when the appliances are energized, the relays will be described as being in the energized state, and in the deenergized state when the appliances are deenergized.

The microswitch is also in a circuit with an audible alarm, such as a horn, and a visual alarm, such as a strobe light. The audible and visual alarms are in a deenergized state when the microswitch is closed, and are moved to the energized state when the microswitch is opened. The horn is also in a circuit with a switch that can be used to deactivate the horn.

During the monitoring cycle, the control system is plugged into a power source, normally a 120 volt AC source, that provides energy to a closed primary circuit including the microswitch and a plurality of appliance control relays that are each connectable to a switch or valve (collectively referred to as controllers) that is interposed between an appliance or other powered device in the kitchen area, and its respective source of energy. The primary circuit is also connected to secondary circuits that include audible and visual alarms.

Fires are detected by a fire detection system that includes a tensioned cable positioned above the areas where fires may occur. For example, the cable may be positioned inside a hood that is located over the cooking applicances. The cable includes heat fusable links above each appliance. Such links are known in the relevant art and include means for connecting cable segments to opposite sides of the link, with the link being constructed of a material that melts at relatively low temperatures.

When exposed to a cooking fire, the link melts to separate the cable. The cable is attached to a moveable member, preferably a pivotal member that has a pivot end and a distal end. The pivotal member is held at a restrained position when the cable is under tension, and moves to a released position when the cable is released.

The fire extinguishing system also includes a source of fire extinguishing chemicals, e.g., a pressurized tank, and conduits or a piping network leading from the fire extinguishing chemical source to discharge nozzles positioned above the cooking appliances. A normally closed control valve is positioned between the chemical source and the nozzles, preventing discharge of chemicals. This valve is positioned in the path of, and engaged by, the moveable member when the movable member is in the released position.

The microswitch in the control circuit is also positioned in the path of the moveable member, and is also engaged by the moveable member in the released position. Thus, when the moveable member is released, the moveable member contacts the fire extinguisher valve, opening the valve to release the extinguishing material. Also, the moveable member contacts the microswitch to open the primary control circuit. As a result, the relays in the primary circuit change state, activating the controller, e.g., opening an electrical switch, or closing a control valve. As a result the supply of energy, e.g., electricity or gas, is terminated.

Another relay in the primary circuit is also in a second circuit with a normally open, audible alarm circuit, and a normally open visual alarm circuit. Opening of the primary circuit causes the relay to change state, closing the alarm circuits to activate the audible and visual alarms, thereby alerting appropriate personnel. The audible alarm can be immediately deactivated by a pushbutton switch or another kind of a switch. However, no provision for opening the visual alarm circuit is provided. Therefore, the visual alarm continues to signal until the primary circuit is restored to its closed state. This restoration cannot occur until the microswitch is again closed, which requires authorized personnel to recharge the fire extinguishing system and restore the cable to its tensioned state.

Accordingly, one aspect of the present invention is to provide an emergency shutdown system to deenergize appliances upon activation of a fire extinguishing system comprising a microswitch moveable between from a closed position to an open position upon activation of the fire extinguishing system. A plurality of relays are in a first circuit with the microswitch, each of the relays being in a second circuit with an applicance controller. The second circuits are closed when the microswitch is in a closed position, and the relays change from a first state to a second state, opening the second circuits when the microswitch is moved to an open position. An audible alarm is in the circuit with the microswitch, the audible alarm being moveable from an unenergized state to an energized state when the microswitch is opened, the audible alarm also being in a circuit with a silencing switch adapted to return the audible alarm to the unenergized state. A visual alarm is also in the circuit with the microswitch, the visual alarm being moveable from an unenergized state to an energized state when the microswitch is opened, the visual alarm being returnable to the unenergized state only when the fire extinguishing system is returned to the recharged and ready state.

Another aspect of the present invention is to provide a fire control system for use with at least one kitchen appliance comprising a fire detection means to activate a fire extinguishing system; a fire extinguishing system activated upon detection of a fire; and a control system. The control system includes a microswitch moveable between from a closed position to an open position upon detection of a fire; a plurality of relays in a first circuit with the microswitch, each of said relays being in a second circuit with an applicance controller; the second circuits being closed when the microswitch is in a closed position. The relays change from a first state to a second state and open the second circuits when the microswitch is moved to an open position. An audible alarm is in a circuit with the microswitch, with the audible alarm being moveable from an unenergized state to an energized state when the microswitch is opened, the audible alarm also being in a circuit with a silencing switch adapted to return the audible alarm to the unenergized state. A visual alarm is also in the circuit with the microswitch, the visual alarm being moveable from an unenergized state to an energized state when the microswitch is opened, the visual alarm being returnable to the unenergized state only when said fire extinguishing system is returned to the recharged and ready state.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
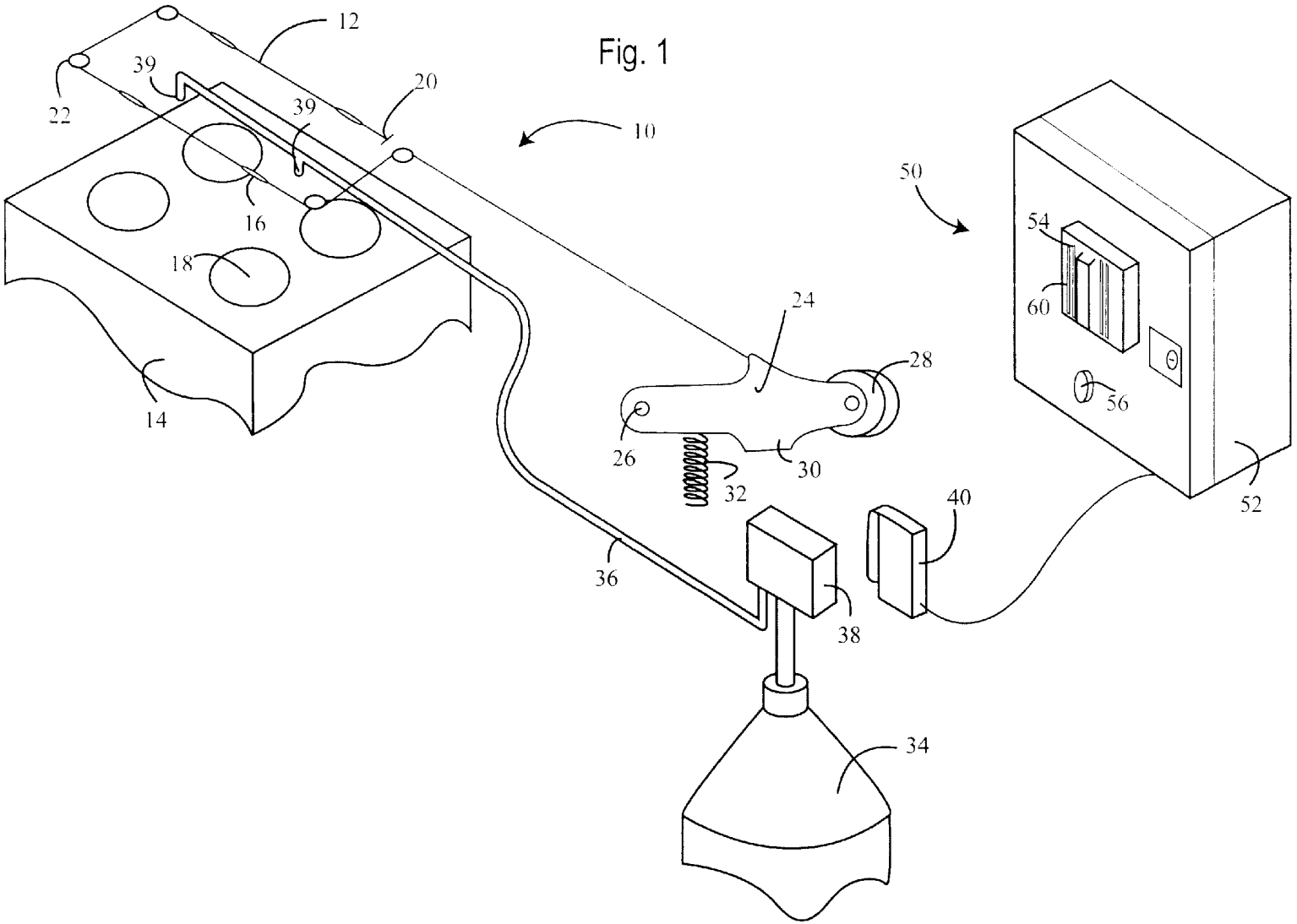
FIG. 1 is a schematic of a fire detection and extinguishing system joined to the control system.

FIG. 1 illustrates a fire detection system, generally 10, that includes a tensioned cable 12 positioned above a typical cooking appliance 14. Cable 12 includes a plurality of heat fusable links 16 positioned above burners 18. Cable 12 has a fixed end 20 attached to a support, and is strung around pulleys 22 to attach at its opposite end to a pivotal member 24. Member 24 includes a pivotal end 26, a first contact element 28 and a second contact element 30. Spring 32 urges pivotal member 24 in a downward direction toward a released position. Pivotal member 24 is held in a restrained position, as illustrated, by cable 12.

A fire extinguishing system comprises a pressurized container 34 connected by conduit 36 through normally closed control valve 38 to discharge nozzles 39 positioned above burners 18. Valve 38 is mounted for engagement by contact element 30 of pivotal member 24 when member 24 is in the released position. Microswitch 40 is positioned for engagement by contact element 28 of pivotal member 24 when member 24 is in the released position.

Figure 2:
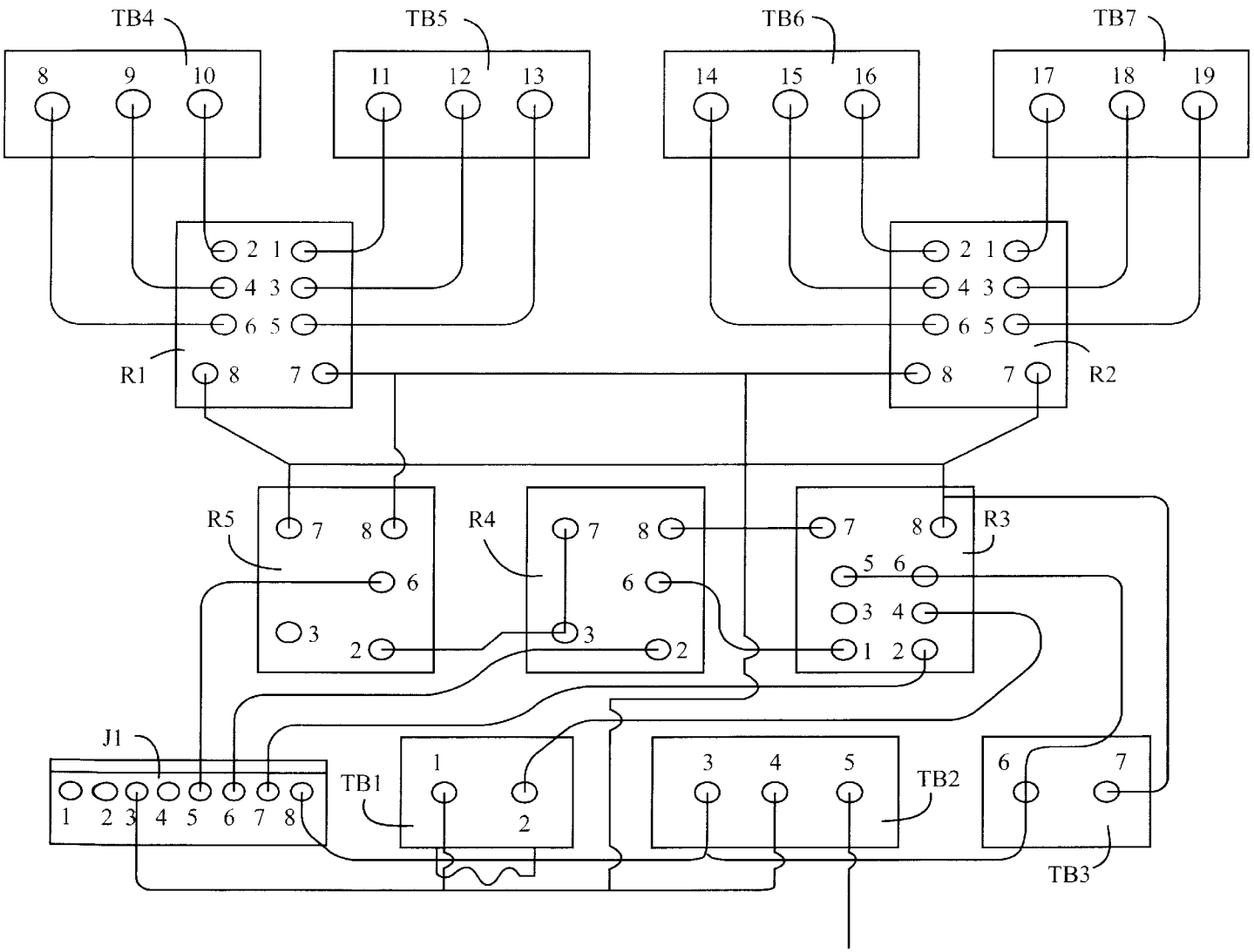
FIGS. 2 and 3 are diagram of the electrical circuit of the preferred embodiment of the invention.
Figure 3:
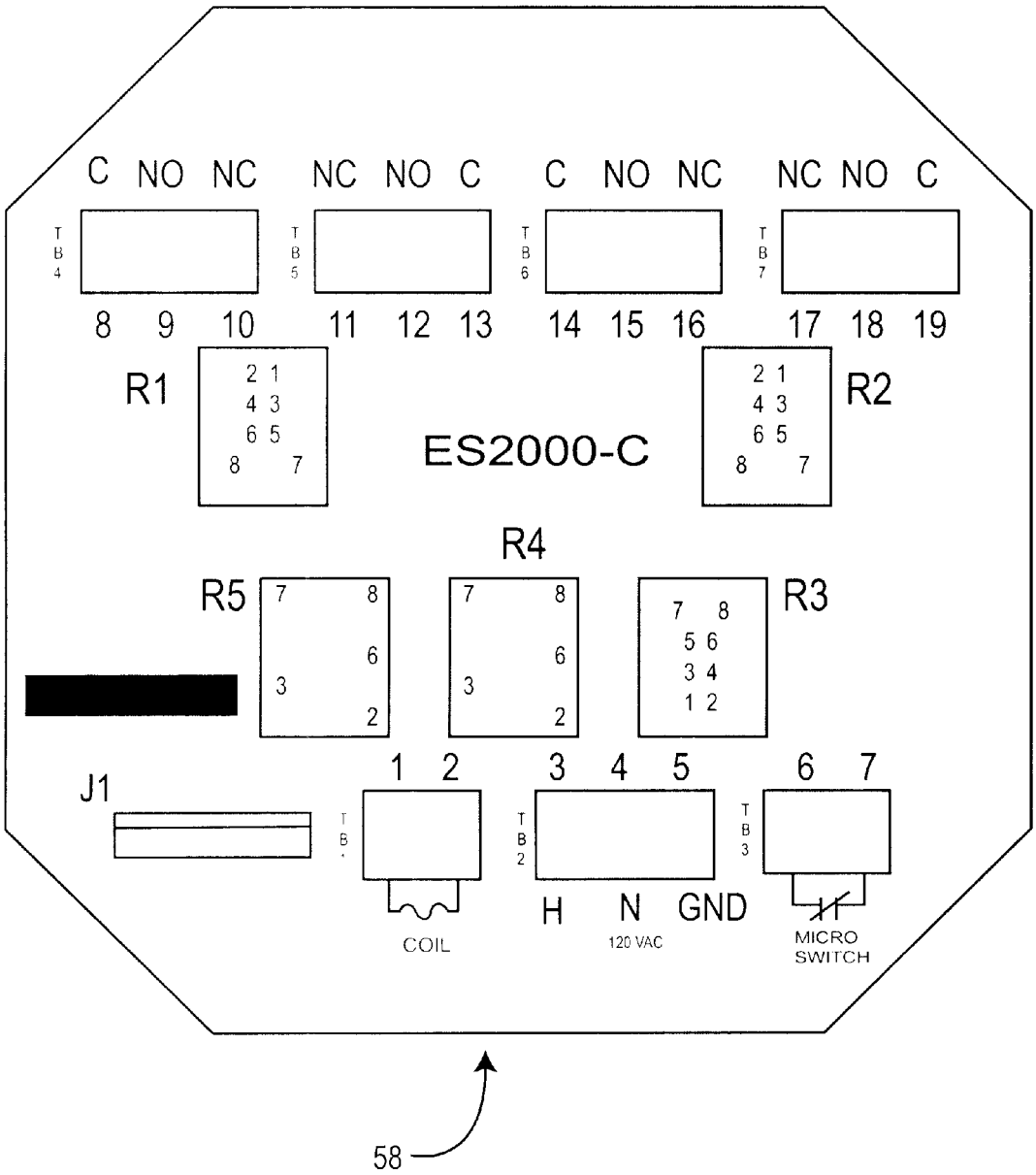

Refer now to FIG. 2 and FIG. 3. The control system, generally 50, is comprised of a lockable housing 52, with a strobe light 54 and audible alarm release button 56 on the front panel of housing 52. A circuit board 58, audible alarm 60, and relevant wiring (not shown) are mounted inside housing 52.

As best illustrated in FIG. 2, the circuit of the invention is comprised of first and second DPDT relays R1 and R2 that are in a primary circuit with DPDT relay R3, and SPST relays R4 and R5. Relay R1 is connected to terminal blocks TB4 and TB5, and relay R2 is connected to terminal blocks TB6 and TB7. Pin connector J1 connects the primary circuit to strobe 54 and horn 60. TB 2 connects to a 120 volt AC source rated at a maximum of 10 amps.

The 120 volt AC input power is connected to terminal block TB2, terminals 3, 4, and 5. These connections are referred to herein by the abbreviations TB2-3, TB2-4, and TB2-5. Other connections will be similarly abbreviated. TB2-3 is used for connection of the hot, 120 volt power source side. TB2-4 is used for connection of the neutral side of the 120 volt power source. TB2-5 is used for connection of the 120 volt AC input ground wire. Terminal block TB3 connects the primary circuit to microswitch 40.

TB2-3 grounding wire is routed, via a solder joint connection, to the chassis connection between circuit board 58 and housing 52 to allow further connection to earth ground via conduit connections per the National Electric Code requirements. TB2-3 is routed to J1-8 (pushbutton common) and TB3-6 (remote microswitch common). TB3-6 is connected to R3-6 and R3-5.

The 120 volt AC neutral connection, TB2-4, is routed to TB1-1 (remote contactor), which is connected to J1-3 (power light), J1-7 (horn), and J1-8 (strobe light). TB1-1 is also attached to R1-7 (coil), R4-8 (coil), and to R2-8, R3-7 and R5-7. The 120 volt AC ground connection, TB2-5, is routed to the chassis ground connection located on circuit board 58.

During normal operation, AC current is routed TB3-6 to the common connection of microswitch 40. The normally closed contact of microswitch 40 is then routed back to TB3-7, and from TB3-7 to R1-8 (coil) and R3-8 (coil) of R2 and R5. Since a circuit now complete, relays R1, R2, R3, and R5 are energized. The relay contacts of R1 and R2 are routed to terminal blocks located on circuit board 58. R1 contacts are routed to TB4-8 (common), TB4-9 (normally open), TB4-10 (normally closed), TB5-11 (normally closed), TB5-12 (normally open), and TB5-13 (common). R2 contacts are routed to TB6-14 (common), TB6-15 (normally open), TB6-16 (normally closed), TB7-17 (normally closed), TB7-18 (normally open), and TB7-19 (common).

TB-4, TB-5, TB-6, and TB-7 are adapted to connect with connectors (either electrical switches or valves) used to control the flow of energy (either electricity or gas) to appliances. Relay contacts are rated 10 amps at 24 volts DC, 120 and 220 volts AC. Relay R3, when energized (the "normal" condition), transfers 120 volt AC hot, from pin R3-4 (normally open when relay R3 is not energized) to TB1-2. TB-1 will then create a 120 volt AC output for remote connection of relays or contactors rated for "normally energized" use. The 120 volt AC output is rated at 10 amps at 24 volts DC, 120 and 220 volts AC.

Using normal operating conditions, the contacts of microswitch 40 are in the normally closed position, all relay contacts are in the working position, and the remote contactor/relay output is energized. Upon loss of wiring integrity between TB3-6 and TB3-7, due to opening of microswitch 40 or a fault in the field wiring, 120 volt AC power will be lost to Relays R1, R2, R3, and R5, causing contacts on TB-4, TB-5, TB-6, and TB-7 to change state. Output on TB1-1 and TB1-2 will drop out.

The 120 volt AC hot, connected to R3-6 (common) will now be routed from pin 2 (normally open when R3 is energized under normal operating condition) to J1-2. J1-2 is routed to the + input of strobe light 54. 120 volt AC hot, connected to R3-5 (common) is routed from pin 1 (normally open when R3 is energized under normal operating condition), to R4-6 (common). R4-6 (common) is routed through R4-2 (normally closed), which is then routed to J1-3, which is connected to an the + input of horn 60. The circuit is now in "alarm" condition, shutdown relay contacts have operated, the contactor/relay output is deactivated, alarm horn 60 is sounding, and strobe light 54 is flashing.

Depressing momentary pushbutton 56 causes contact closure of a normally open contact block. One side of the contact block is connected to J1-1, and the other side of the contact block is connected to J1-4. Closure of the contact block allows 120 volt AC power to pass from J1-1 (120 volt AC hot), to J1-4, which is connected to R5-6 (common). R5-6 (common) is routed to R5-2 (normally open when R5 is energized under normal operating condition). R5-2 is connected to R4-3 (normally open when R4 is energized under normal operating condition), and R4-7 (coil).

R4 is thereby energized, allowing power from R4-6 (via contact pin 3) to the coil. This is in turn energizes the relay in a "latched" mode. With R4 in a "latched" mode (energized), R4-2 (normally open under normal operating condition) returns to a normally open state, and breaks the 120 volt AC Hot connection directed to J1-3, in turn silencing alarm horn 60. Even though horn 60 has been silenced, strobe light 54 will still flash, the shutdown contacts will remain in the "off" mode, and the contactor/relay output remain de-energized. Strobe 54 continues to flash until the fire detection system has be repaired, the fire extinguishing systems have been recharged, and the entire system has been returned to its ready state.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. An emergency shutdown system to deenergize appliances upon detection of a fire by a fire detection system comprising:

a) a microswitch moveable between from a closed position to an open position upon activation of said fire extinguishing system;

b) a plurality of relays in a first circuit with said microswitch, each of said relays being in a second circuit with an appliance controller; said second circuits being closed when said microswitch is in a closed position, said relays changing from a first state to a second state and opening said second circuits when said microswitch is moved to an open position;

c) an audible alarm in a circuit with said microswitch, said audible alarm being moveable from an unenergized state to an energized state when said microswitch is opened, said audible alarm also being in a circuit with a silencing switch adapted to return said audible alarm to the unenergized state; and d) a visual alarm in circuit with said microswitch, said visual alarm being moveable from an unenergized state to an energized state when said microswitch is opened, said visual alarm being returnable to the unenergized state only when said fire extinguishing system is returned to the ready state.

2. The system of claim 1, wherein said microswitch is moved from said closed state to said open state by a component of said fire detection system.

3. The system of claim 1, wherein said appliance controller is an electrical switch in a circuit with an electrical appliance.

4. The system of claim 1, wherein said appliance controller is a valve in a fuel line connected to a gas appliance.

5. The system of claim 1, further including a lockable housing, with said visual alarm being positioned on the exterior of said housing.

6. The system of claim 1, wherein said first circuit is a 120 volt AC powered circuit.

7. A fire control system for use with at least one kitchen appliance comprising:

a) a fire detection system to detect a fire;

b) a fire extinguishing system activated upon detection of a fire by said fire detection system;

c) a microswitch moveable between from a closed position to an open position upon detection of a fire;

d) a plurality of relays in a first circuit with said microswitch, each of said relays being in a second circuit with an appliance; said second circuits being closed when said microswitch is in a closed position, said relays changing from a first state to a second state and opening said second circuits when said microswitch is moved to an open position;

e) an audible alarm in a circuit with said microswitch, said audible alarm being moveable from an unenergized state to an energized state when said microswitch is opened, said audible alarm also being in a circuit with a silencing switch adapted to return said audible alarm to the unenergized state; and f) a visual alarm in circuit with said microswitch, said visual alarm being moveable from an unenergized state to an energized state when said microswitch is opened, said visual alarm being returnable to the unenergized state only when said fire extinguishing system is returned to the ready state.

8. The system of claim 7, wherein said fire detection means includes a tensioned cable having heat fusable links positioned above said appliance.

9. The system of claim 8, wherein said fire detection means includes a moveable member moveable from a first position to a second position upon detection of a fire, said fire extinguishing system including a valve positioned at said second position for contact with said moveable member when said moveable member is at said second position, thereby activating said fire extinguishing system.

10. The system of claim 7, wherein said fire extinguishing system includes a source of fire extinguishing material, at least one discharge nozzle above said appliance, a conduit leading from said source to said nozzle, and an inline valve in said conduit, said valve being opened upon detection of a fire to permit movement of fire extinguishing material from said source to said nozzle.

11. The system of claim 7, wherein said fire detection means includes a moveable member moveable from a first position to a second position upon detection of a fire, said microswitch being positioned at second position for contact with said moveable member when said moveable member is at said second position, thereby moving said microswitch for a closed position to an open position.

12. A fire control system for use with a plurality of kitchen appliances comprising:

a) a cable with heat fusable links positioned above said appliances, said cable having a fixed end and a second end;

b) a moveable member having a restrained position and a released position, said cable second end being attached to said moveable member, said cable being under tension when said moveable member is in said restrained position;

c) a fire extinguishing system activated upon detection of a fire;

d) a microswitch positioned for engagement by said moveable member when said moveable member is in said released position, said microswitch being moved from a normally closed position to an open position when engaged by said moveable member;

e) a plurality of relays in a first circuit with said microswitch, each of said relays being in a second circuit with an appliance; said second circuits being closed when said microswitch is in said normally closed position, said relays changing from a first state to a second state and opening said second circuits when said microswitch is moved to an open position;

f) an audible alarm in a circuit with said microswitch, said audible alarm being moveable from an unenergized state to an energized state when said microswitch is opened, said audible alarm also being in a circuit with a silencing switch adapted to return said audible alarm to the unenergized state; and g) a visual alarm in circuit with said microswitch, said visual alarm being moveable from an unenergized state to an energized state when said microswitch is opened, said visual alarm being returnable to the unenergized state only when said fire extinguishing system is returned to the ready state.

13. The system of claim 12, wherein said moveable member is a pivotal member having a pivotal end and a contact element for contacting said microswitch when in said released position, said pivotal member being attached to said cable second end when in said restrained position, and urged toward said released position by a spring, said pivotal member being movable to said released position upon release of said cable.

14. The system of claim 12, wherein said fire extinguishing system includes a source of fire extinguishing material, at least one discharge nozzle directed toward said appliance, a conduit leading from said source to said nozzle, and an inline valve in said conduit, said valve being engaged by said pivotal member when said pivotal member is in the released positioned to permit movement of fire extinguishing material from said source to said nozzle.

* * * * *